US007356999B2

(12) United States Patent
Bodell, II et al.

(10) Patent No.: US 7,356,999 B2
(45) Date of Patent: Apr. 15, 2008

(54) SYSTEM AND METHOD FOR STABILITY CONTROL IN A CENTRIFUGAL COMPRESSOR

(75) Inventors: Mark Robinson Bodell, II, York, PA (US); Robert Edward Stabley, Dallastown, PA (US); Wanda Jean Miller, Harrisburg, PA (US)

(73) Assignee: York International Corporation, York, PA (US)

( * ) Notice: Subject to any disclaimer, the term of this patent is extended or adjusted under 35 U.S.C. 154(b) by 713 days.

(21) Appl. No.: 10/683,772

(22) Filed: Oct. 10, 2003

(65) Prior Publication Data

US 2005/0076656 A1 Apr. 14, 2005

(51) Int. Cl.

| | |
|---|---|
| ***F25B 1/00*** | (2006.01) |
| ***F25B 49/00*** | (2006.01) |
| ***F01B 25/00*** | (2006.01) |
| ***F01D 17/00*** | (2006.01) |

(52) U.S. Cl. ..... 62/228.3; 62/228.5; 415/47; 415/119; 415/146; 415/148

(58) Field of Classification Search ..... 62/228.3, 62/228.5; 415/47, 148, 146, 119, 150
See application file for complete search history.

(56) References Cited

U.S. PATENT DOCUMENTS

| | | | | |
|---|---|---|---|---|
| 3,362,624 A | | 1/1968 | Endress | |
| 4,212,585 A | | 7/1980 | Swarden et al. | |
| 4,248,055 A | | 2/1981 | Day, III et al. | |
| 4,503,684 A | | 3/1985 | Mount et al. | |
| 4,611,969 A | | 9/1986 | Zinsmeyer | |
| 4,616,483 A | * | 10/1986 | Leonard | 62/115 |
| 4,697,980 A | | 10/1987 | Keyes, IV et al. | |
| 4,900,232 A | | 2/1990 | Dziubakowski et al. | |
| 5,005,353 A | | 4/1991 | Acton et al. | |

(Continued)

FOREIGN PATENT DOCUMENTS

EP 0896157 A1 2/1999

(Continued)

OTHER PUBLICATIONS

Langill, A. W.: "Microprocessor-Based Control of Large Constant-Speed Centrifugal Compressors", Proceedings of the International Instrumentation Symposium, vol. 2, 1982, pp. 591-602, XP008042589.

(Continued)

*Primary Examiner*—Marc Norman
(74) *Attorney, Agent, or Firm*—McNees Wallace & Nurick LLC

(57) ABSTRACT

A stability control algorithm is provided for a centrifugal compressor. The stability control algorithm is used to control a variable geometry diffuser and a hot gas bypass valve (when provided) in response to the detection of compressor instabilities. The stability control algorithm can adjust the position of a diffuser ring in the variable geometry diffuser in response to the detection of a surge condition or a stall condition. In addition, the diffuser ring in the variable geometry diffuser can be adjusted to determine an optimal position of the diffuser ring. The stability control algorithm can also be used to open a hot gas bypass valve in response to the detection of continued surge conditions.

37 Claims, 5 Drawing Sheets

U.S. PATENT DOCUMENTS

| | | | | |
|---|---|---|---|---|
| 5,116,197 | A * | 5/1992 | Snell | 415/126 |
| 5,146,764 | A * | 9/1992 | Bauman et al. | 62/228.5 |
| 5,190,440 | A | 3/1993 | Maier et al. | |
| 5,199,856 | A | 4/1993 | Epstein et al. | |
| 5,235,801 | A * | 8/1993 | Evenson et al. | 60/773 |
| 5,437,539 | A | 8/1995 | Gysling et al. | |
| 5,594,665 | A | 1/1997 | Walter et al. | |
| 5,658,125 | A | 8/1997 | Burns et al. | |
| 5,730,580 | A | 3/1998 | Japikse | |
| 5,807,071 | A * | 9/1998 | Brasz et al. | 415/150 |
| 6,036,432 | A | 3/2000 | Sishtla et al. | |
| 6,129,511 | A | 10/2000 | Salvage et al. | |
| 6,139,262 | A | 10/2000 | Ravidranath | |
| 6,203,275 | B1 | 3/2001 | Kobayashi et al. | |
| 6,231,301 | B1 | 5/2001 | Barnett et al. | |
| 6,506,010 | B1 | 1/2003 | Yeung et al. | |
| 6,872,050 | B2 * | 3/2005 | Nenstiel | 415/151 |
| 2001/0014837 | A1 | 8/2001 | Escuret et al. | |
| 2002/0094267 | A1 | 7/2002 | Kim et al. | |
| 2002/0161550 | A1 | 10/2002 | Bharadwaj et al. | |
| 2004/0037693 | A1 * | 2/2004 | Stabley et al. | 415/1 |

FOREIGN PATENT DOCUMENTS

| | | |
|---|---|---|
| EP | 1256726 A1 | 11/2002 |
| EP | 1321679 A1 | 6/2003 |
| JP | 2002371989 | 12/2002 |
| WO | WO 90/10148 | 9/1990 |
| WO | WO 97/00381 | 1/1997 |
| WO | WO 2004/053336 A1 | 6/2004 |

OTHER PUBLICATIONS

Eveker, et al.: "Control of Compression System Surge and Rotating Stall: A Laboratory-Based Hands-On Introduction", Proceedings of the American Control Conference, San Francisco, Jun. 2, vol. 1, Jun. 2, 1993, pp. 1307-1311, XP008042590.

Willems et al.: "Modeling and Control of Rotating Stall and Surge: An Overview", Control Applications, 1998, Proceedings of the 1998 IEEE International Conference on Trieste, Italy Sep. 1-4, 1998, New York, NY, USA, IEEE, US, vol. 1, Sep. 1, 1998, pp. 331-335, XP010307317.

De Jager, B.: "Rotating Stall and Surge Control: A Survey", Decision and Control, 1995, Proceedings of the 34th IEEE Conference on New Orleans, LA, USA Dec. 13-15, 1995, New York, NY, USA, IEEE, US, vol. 2, Dec. 13, 1995, pp. 1857-1862, X-010152264.

Day et al.: "Centrifugal Compressor Multi-Mode Rotating Stall Control", Proceedings of the International Compressor Engineering Conference—at Purdue, vol. 1, Jul. 25, 2000, pp. 47-54, XP008042716.

* cited by examiner

SYSTEM AND METHOD FOR STABILITY CONTROL IN A CENTRIFUGAL COMPRESSOR

BACKGROUND OF THE INVENTION

The present invention relates generally to a control system and method for stability control of a centrifugal compressor. More specifically, the present invention relates to systems and methods for controlling a variable geometry diffuser mechanism of a centrifugal compressor in response to compressor instability conditions.

A centrifugal compressor may encounter instabilities such as surge or stall during the operation of the compressor. Surge or surging is an unstable condition that may occur when a centrifugal compressor is operated at light loads and high pressure ratios. Surge is a transient phenomenon having oscillations in pressures and flow, and, in some cases, the occurrence of a complete flow reversal through the compressor. Surging, if uncontrolled, can cause excessive vibrations in both the rotating and stationary components of the compressor, and may result in permanent compressor damage. One technique to correct or remedy a surge condition may involve the opening of a hot gas bypass valve to return some of the discharge gas of the compressor to the compressor inlet to increase the flow at the compressor inlet.

Rotating stall in a centrifugal compressor can occur in the rotating impeller of the compressor or in the stationary diffuser of the compressor downstream from the impeller. In both cases, the presence of rotating stall can adversely affect performance of the compressor and/or system. Mixed flow centrifugal compressors with vaneless radial diffusers can experience diffuser rotating stall during some part, or in some cases, all of their intended operating range. Typically, diffuser rotating stall occurs because the design of the diffuser is unable to accommodate all flows without some of the flow experiencing separation in the diffuser passageway. Diffuser rotating stall results in the creation of low frequency sound energy or pulsations. These pulsations may have high magnitudes in the gas flow passages and may result in the premature failure of the compressor, its controls, or other associated parts/systems. One technique to correct or remedy a stall condition in a centrifugal compressor may involve the closing of the diffuser space in a variable geometry diffuser. Closing of the diffuser space may also enhance the compressor's ability to resist surge conditions. However, excessive closure of the diffuser gap can reduce the flow rate or capacity through the compressor.

Therefore what is needed is a system and method for coordinating the control of a variable geometry diffuser (and an optional hot gas bypass valve, if present) in a centrifugal compressor to enhance the compressor's ability to resist stall and/or surge and provide stable operation of the centrifugal compressor.

SUMMARY OF THE INVENTION

One embodiment of the present invention is directed to a liquid chiller system having a centrifugal compressor configured to compress a refrigerant vapor. The centrifugal compressor has a compressor inlet to receive uncompressed refrigerant vapor and a compressor exit to discharge compressed refrigerant vapor. Internally, the compressor has a diffuser that has an adjustable diffuser ring to vary the flow passage of the compressed refrigerant vapor through the diffuser. The liquid chiller system also includes an optional hot gas bypass valve connected between the compressor exit and inlet. The optional hot gas bypass valve is configured to permit a portion of the compressed refrigerant vapor to flow to the compressor inlet from the compressor exit, which is used to maintain a minimum refrigerant vapor flow rate through the compressor. The liquid chiller system further includes a stability control system to control the diffuser and the optional hot gas bypass valve to maintain stable operation of the centrifugal compressor. The stability control system has a stall reacting state to control the diffuser ring in response to detecting a stall condition in the centrifugal compressor, a surge reacting state to control the diffuser ring in response to detecting a surge condition in the centrifugal compressor, a hot gas override state to control the optional hot gas bypass valve in response to detecting a second surge condition in the centrifugal compressor, and a probing state to control the diffuser ring to obtain an optimal position for the diffuser ring.

Another embodiment of the present invention is directed to a chiller system having a compressor, a condenser, and an evaporator connected in a closed refrigerant circuit. The compressor includes a compressor inlet to receive uncompressed refrigerant vapor from the chiller system, a compressor outlet to discharge compressed refrigerant vapor to the chiller system, and a diffuser being disposed adjacent to the compressor outlet. The diffuser having a diffuser space configured to permit passage of compressed refrigerant vapor to the compressor outlet and a diffuser ring adjustably positioned in the diffuser space to vary a size of the diffuser space to control flow of compressed refrigerant vapor through the diffuser space. The chiller system also includes a stability control system to control the position of the diffuser ring in the diffuser space in response to the detection of stall conditions and surge conditions in the compressor to maintain stable operation of the compressor.

Still another embodiment of the present invention is directed to a stability control system for maintaining stable operation of a centrifugal compressor having a compressor inlet, a compressor outlet and a variable geometry diffuser with an adjustable flow passage. The stability control system having a stall reacting state to adjust a flow passage of a variable geometry diffuser in response to detecting a stall condition in a centrifugal compressor and a surge reacting state to adjust a flow passage of a variable geometry diffuser in response to detecting a surge condition in a centrifugal compressor.

A further embodiment of the present invention is directed to a method of providing stability control in a centrifugal compressor having a variable geometry diffuser with an adjustable flow passage. The method including the steps of repeatedly detecting for a surge condition in a centrifugal compressor during operation of a centrifugal compressor; repeatedly detecting for a stall condition in a centrifugal compressor during operation of a centrifugal compressor; continuously closing a flow passage of a variable geometry diffuser in response to the detection of a surge condition in a centrifugal compressor for a predetermined surge reaction time period; and continuously closing a flow passage of a variable geometry diffuser in response to the detection of a stall condition in a centrifugal compressor until the detected stall condition is corrected or a surge condition is detected.

One advantage of the present invention is that a centrifugal compressor can be controlled to efficiently react to both the presence of surge conditions and stall conditions.

Another advantage of the present invention is that the use of a hot gas bypass valve, if present, can be minimized to provide greater energy efficiency.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
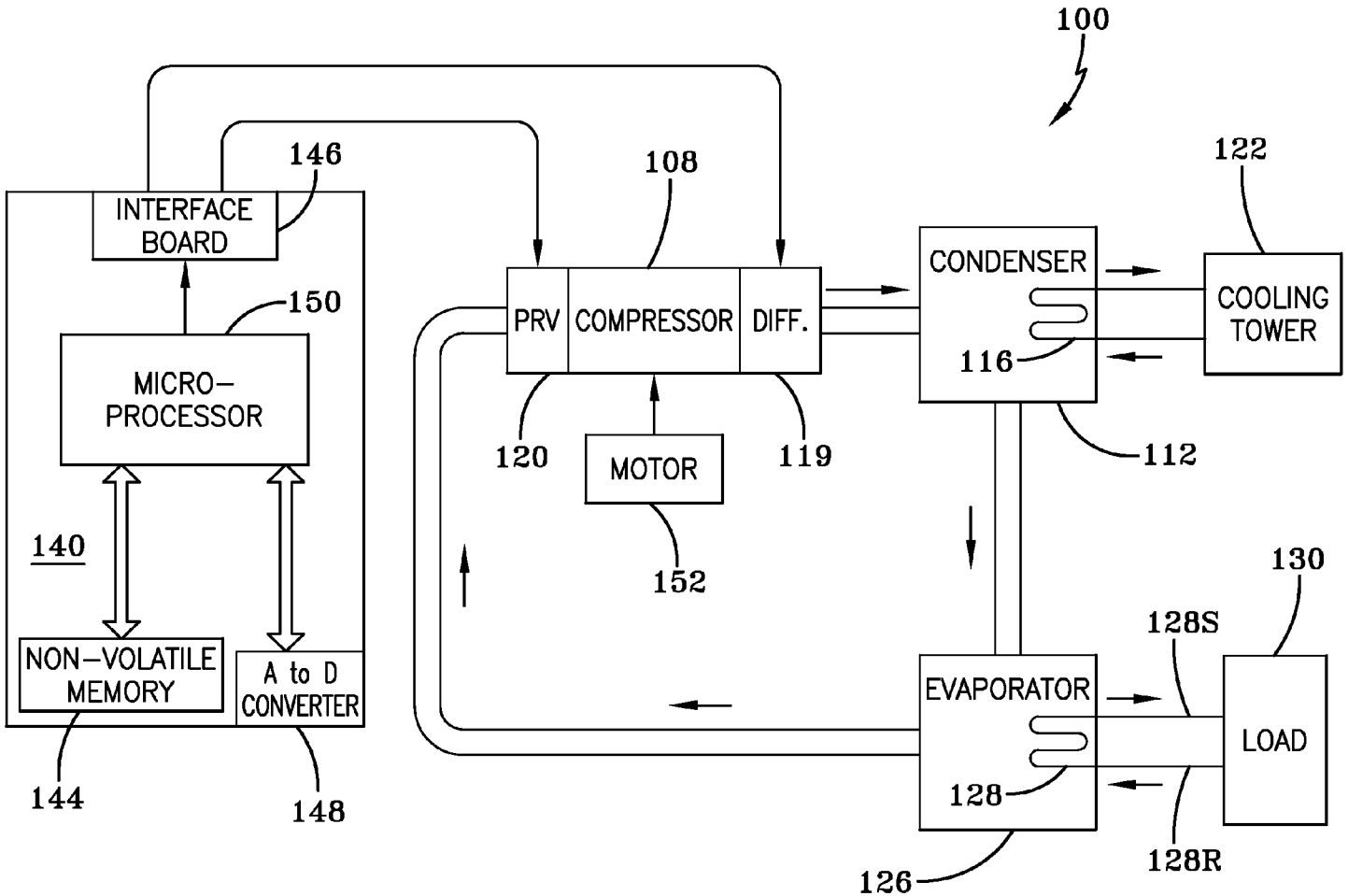
FIG. 1 illustrates schematically a refrigeration system of the present invention.

A general system to which the invention can be applied is illustrated, by means of example, in FIG. 1. As shown, the HVAC, refrigeration or liquid chiller system 100 includes a compressor 108, a condenser 112, a water chiller or evaporator 126, and a control panel 140. The control panel 140 can include an analog to digital (A/D) converter 148, a microprocessor 150, a non-volatile memory 144, and an interface board 146. The operation of the control panel 140 will be discussed in greater detail below. The conventional liquid chiller system 100 includes many other features that are not shown in FIG. 1. These features have been purposely omitted to simplify the drawing for ease of illustration.

Compressor 108 compresses a refrigerant vapor and delivers the vapor to the condenser 112 through a discharge line. The compressor 108 is preferably a centrifugal compressor. To drive the compressor 108, the system 100 includes a motor or drive mechanism 152 for compressor 108. While the term "motor" is used with respect to the drive mechanism for the compressor 108, it is to be understood that the term "motor" is not limited to a motor but is intended to encompass any component that can be used in conjunction with the driving of motor 152, such as a variable speed drive and a motor starter. In a preferred embodiment of the present invention, the motor or drive mechanism 152 is an electric motor and associated components. However, other drive mechanisms such as steam or gas turbines or engines and associated components can be used to drive the compressor 108.

The refrigerant vapor delivered by the compressor 108 to the condenser 112 enters into a heat exchange relationship with a fluid, e.g., air or water, and undergoes a phase change to a refrigerant liquid as a result of the heat exchange relationship with the fluid. The condensed liquid refrigerant from condenser 112 flows through an expansion device (not shown) to an evaporator 126. In a preferred embodiment, the refrigerant vapor in the condenser 112 enters into the heat exchange relationship with water, flowing through a heat-exchanger coil 116 connected to a cooling tower 122. The refrigerant vapor in the condenser 112 undergoes a phase change to a refrigerant liquid as a result of the heat exchange relationship with the water in the heat-exchanger coil 116.

The evaporator 126 can preferably include a heat-exchanger coil 128 having a supply line 128S and a return line 128R connected to a cooling load 130. The heat-exchanger coil 128 can include a plurality of tube bundles within the evaporator 126. A secondary liquid, which is preferably water, but can be any other suitable secondary liquid, e.g., ethylene, calcium chloride brine or sodium chloride brine, travels into the evaporator 126 via return line 128R and exits the evaporator 126 via supply line 128S. The liquid refrigerant in the evaporator 126 enters into a heat exchange relationship with the secondary liquid in the heat-exchanger coil 128 to chill the temperature of the secondary liquid in the heat-exchanger coil 128. The refrigerant liquid in the evaporator 126 undergoes a phase change to a refrigerant vapor as a result of the heat exchange relationship with the secondary liquid in the heat-exchanger coil 128. The vapor refrigerant in the evaporator 126 exits the evaporator 126 and returns to the compressor 108 by a suction line to complete the cycle. While the system 100 has been described in terms of preferred embodiments for the condenser 112 and evaporator 126, it is to be understood that any suitable configuration of condenser 112 and evaporator 126 can be used in the system 100, provided that the appropriate phase change of the refrigerant in the condenser 112 and evaporator 126 is obtained.

At the input or inlet to the compressor 108 from the evaporator 126, there are one or more pre-rotation vanes (PRV) or inlet guide vanes 120 that control the flow of refrigerant to the compressor 108. An actuator is used to open the pre-rotation vanes 120 to increase the amount of refrigerant to the compressor 108 and thereby increase the cooling capacity of the system 100. Similarly, the actuator is used to close the pre-rotation vanes 120 to decrease the amount of refrigerant to the compressor 108 and thereby decrease the cooling capacity of the system 100.

Figure 2:
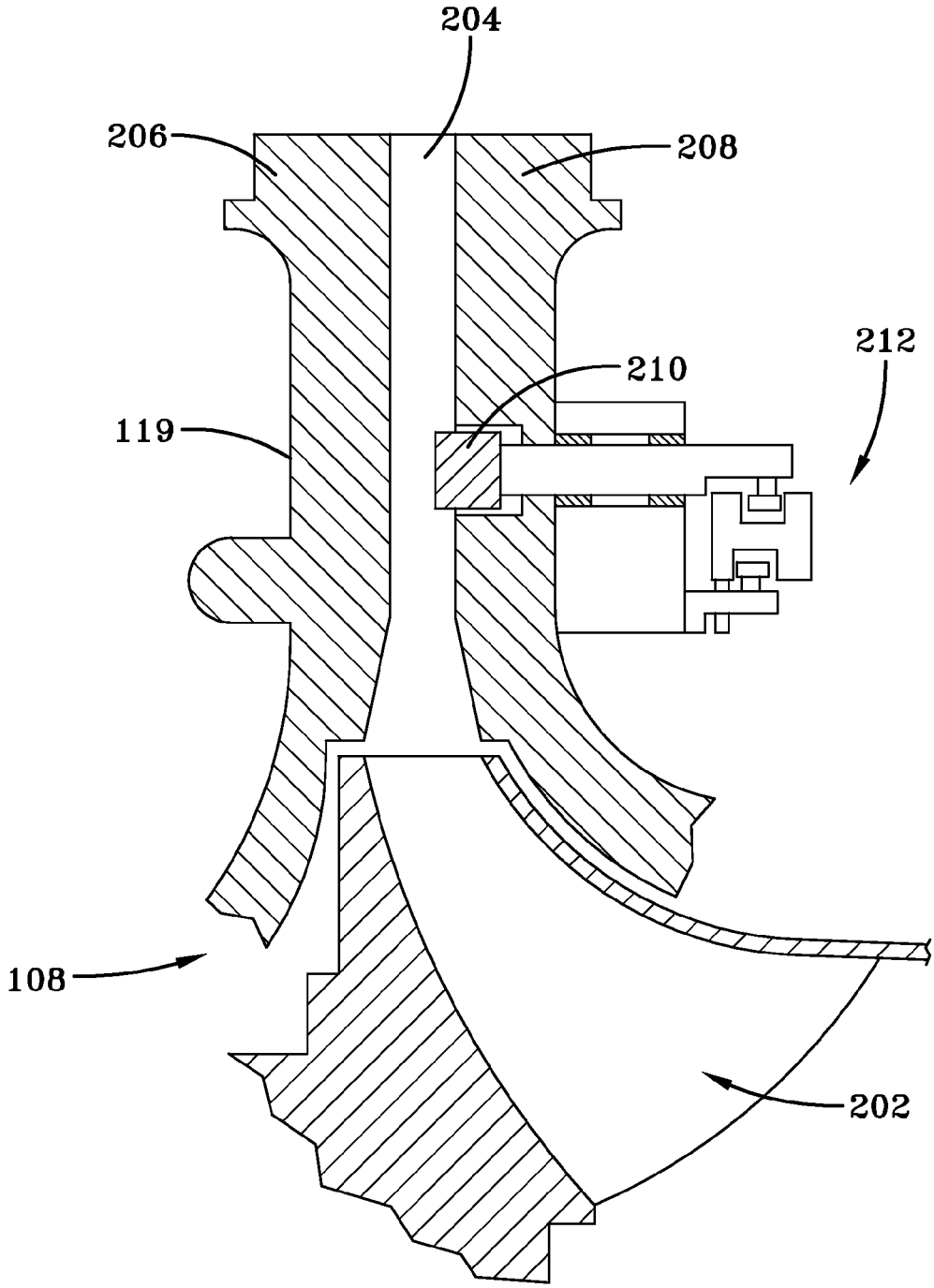
FIG. 2 illustrates a partial sectional view of a centrifugal compressor and diffuser used with the present invention.

FIG. 2 illustrates a partial sectional view of the compressor 108 of a preferred embodiment of the present invention. The compressor 108 includes an impeller 202 for compressing the refrigerant vapor. The compressed vapor then passes through a diffuser 119. The diffuser 119 is preferably a vaneless radial diffuser having a variable geometry. The variable geometry diffuser (VGD) 119 has a diffuser space 204 formed between a diffuser plate 206 and a nozzle base plate 208 for the passage of the refrigerant vapor. The nozzle base plate 208 is configured for use with a diffuser ring 210. The diffuser ring 210 is used to control the velocity of refrigerant vapor that passes through the diffuser space or passage 204. The diffuser ring 210 can be extended into the diffuser passage 204 to increase the velocity of the vapor flowing through the passage and can be retracted from the diffuser passage 204 to decrease the velocity of the vapor flowing through the passage. The diffuser ring 210 can be extended and retracted using an adjustment mechanism 212 driven by an electric motor to provide the variable geometry of the diffuser 119. A more detailed description of the operation and components of one type of variable geometry diffuser 119 is provided in U.S. patent application Ser. No. 10/313,364, filed on Dec. 6, 2002, which patent application is hereby incorporated by reference. However, it is to be understood that any suitable VGD 119 can be used with the present invention.

The control panel 140 has an A/D converter 148 to preferably receive input signals from the system 100 that indicate the performance of the system 100. For example, the input signals received by the control panel 140 can include the position of the pre-rotation vanes 120, the temperature of the leaving chilled liquid temperature from the evaporator 126, pressures of the evaporator 126 and condenser 112, and an acoustic or sound pressure measurement in the compressor discharge passage. The control panel 140 also has an interface board 146 to transmit signals to components of the system 100 to control the operation of the system 100. For example, the control panel 140 can transmit signals to control the position of the pre-rotation vanes 120, to control the position of an optional hot gas bypass valve 134 (see FIG. 4), if present, and to control the position of the diffuser ring 210 in the variable geometry diffuser 119. The control panel 140 may also include many other features and components that are not shown in FIG. 1. These features and components have been purposely omitted to simplify the control panel 140 for ease of illustration.

The control panel 140 uses a control algorithm(s) to control operation of the system 100 and to determine when to extend and retract the diffuser ring 210 in the variable geometry diffuser 119 in response to particular compressor conditions in order to maintain system and compressor stability. Additionally, the control panel 140 can use the control algorithm(s) to open and close the optional, hot gas bypass valve 134 (see FIGS. 4 and 5), if present, in response to particular compressor conditions in order to maintain system and compressor stability. In one embodiment, the control algorithm(s) can be computer programs stored in non-volatile memory 144 having a series of instructions executable by the microprocessor 150. While it is preferred that the control algorithm be embodied in a computer program(s) and executed by the microprocessor 150, it is to be understood that the control algorithm may be implemented and executed using digital and/or analog hardware by those skilled in the art. If hardware is used to execute the control algorithm, the corresponding configuration of the control panel 140 can be changed to incorporate the necessary components and to remove any components that may no longer be required, e.g. the A/D converter 148.

Figure 3:
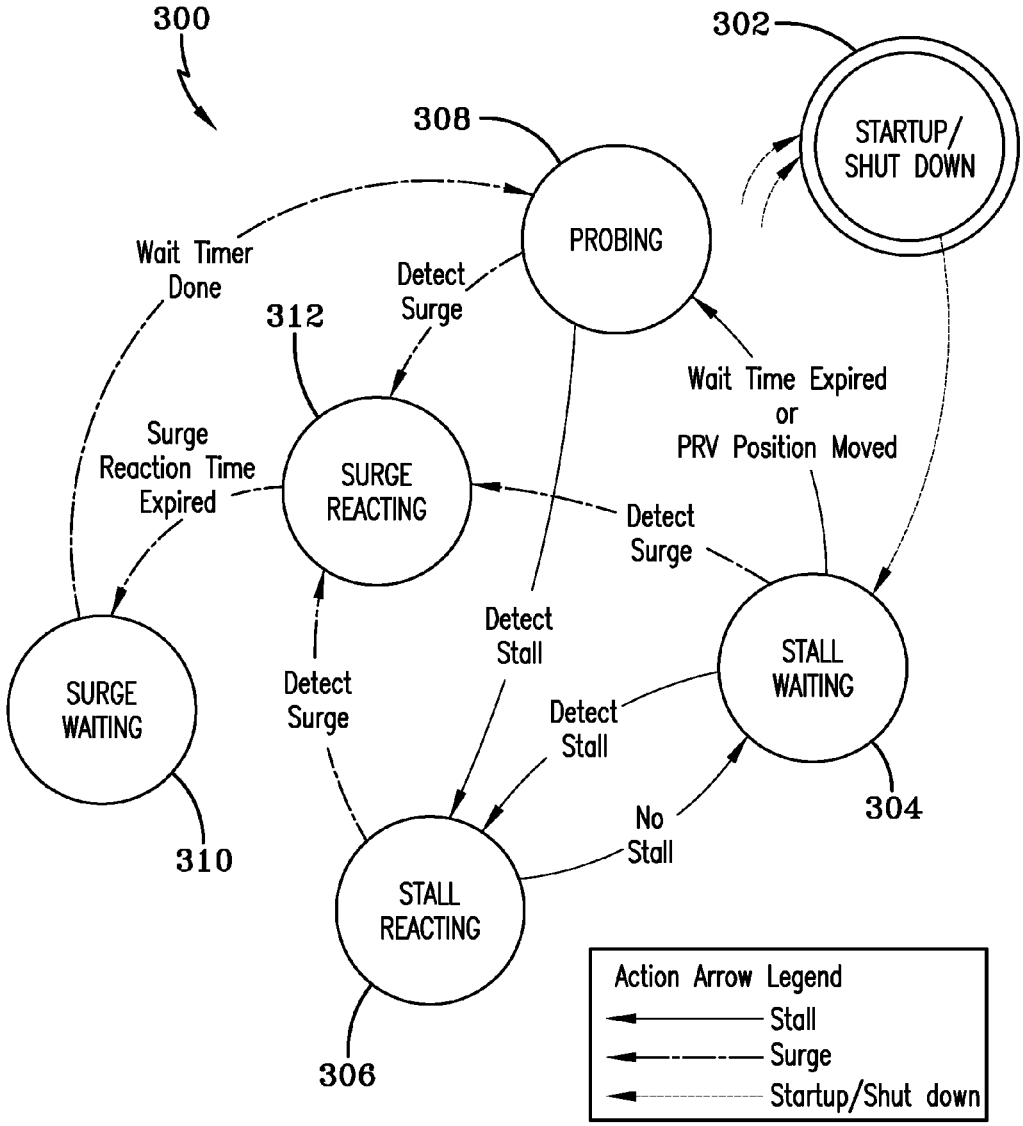
FIG. 3 illustrates a state diagram for the control system and method of the present invention for use with the refrigeration system illustrated in FIG. 1.
Figure 5:
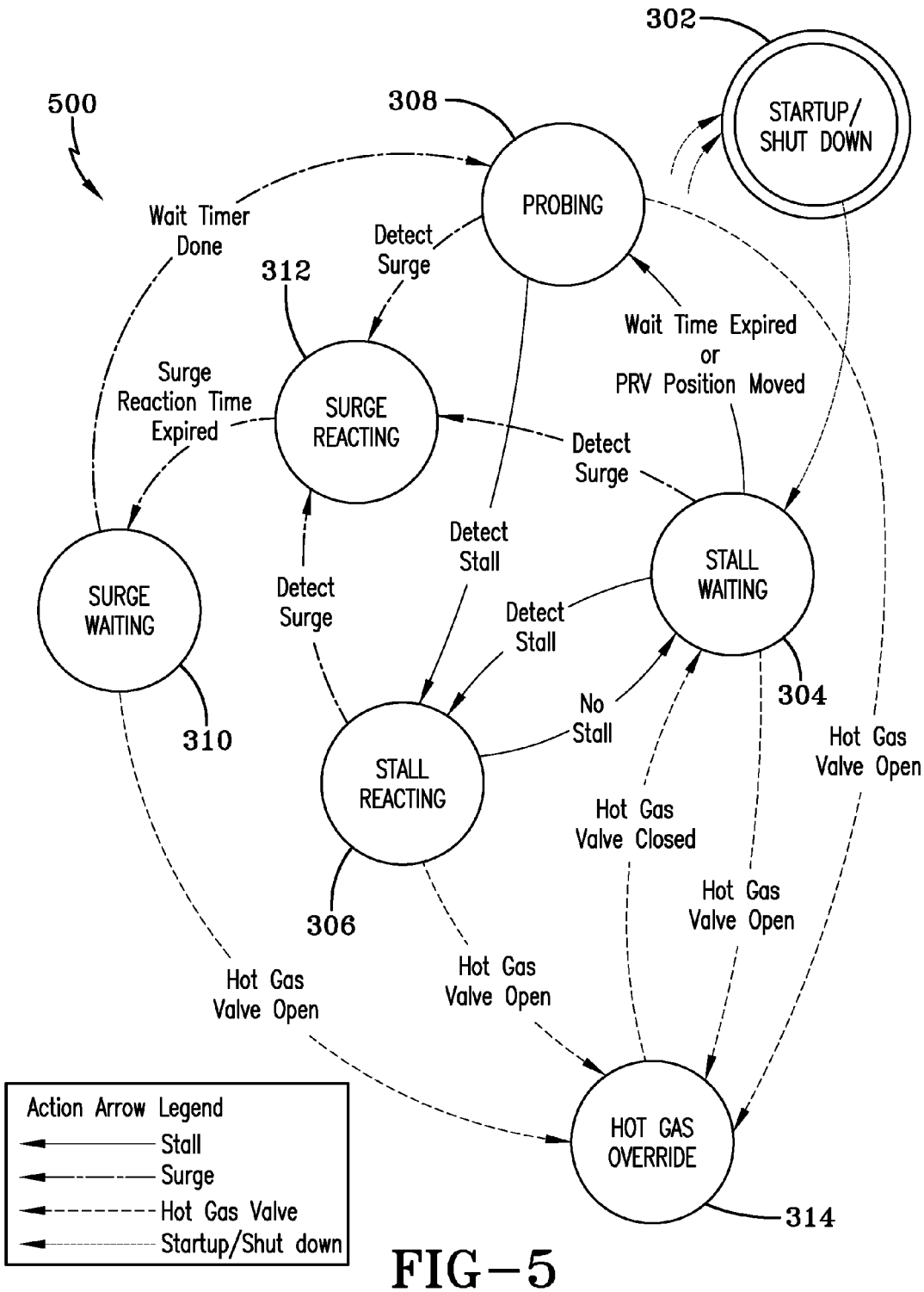
FIG. 5 illustrates a state diagram for the control system and method of the present invention for use with the refrigeration system illustrated in FIG. 4.

FIGS. 3 and 5 are state diagram representations of stability control algorithms of the present invention for maintaining compressor and system stability. The stability control algorithms may be executed as separate programs with respect to the other control algorithms for the system, e.g., an operational control algorithm, or the stability control algorithm can be incorporated into the other control algorithms of the system. As shown in FIG. 3, a state diagram 300 for one embodiment of the stability control algorithm of the present invention for providing stability control to the system 100 of FIG. 1 has six primary control states. The primary control states include: a startup/shutdown state 302; a stall waiting state 304; a stall reacting state 306; a probing state 308; a surge waiting state 310; and a surge reacting state 312.

The startup/shutdown state 302 is the first and last control state in the stability control algorithm 300 during operation of the system 100. Upon starting or initiating the system 100 from an inactive state, the stability control algorithm 300 enters the startup/shutdown state 302. Similarly, when the system 100 is to be stopped or shutdown, the startup/shutdown state 302 is entered from any one of the other control states in the stability control algorithm 300 in response to a shutdown command from another control algorithm controlling the system 100 or the stability control algorithm 300. The stability control algorithm 300 remains in the startup/shutdown state 302 until the compressor 108 is started. In the startup/shutdown state 302 the diffuser ring 210 of the variable geometry diffuser 119 is moved to a fully open or retracted position to thereby fully open the diffuser space 204.

The stall waiting state 304 is entered after the compressor 108 has started. In addition, the stall waiting state 304 can be entered following the correction of a stall condition in the stall reacting state 306. The stability control algorithm 300 remains in the stall waiting state 304 until one of the following conditions occurs: a predetermined stall waiting period expires; a surge condition is detected; a stall condition is detected; or the pre-rotation vanes 120 are moved more than a predetermined PRV offset amount. The movement of the pre-rotation vanes 120 can be an indicator that compressor conditions (e.g., flow and/or head) are changing and may require adjustment of the variable geometry diffuser 119. In one embodiment of the present invention, the predetermined stall waiting period can range from about 0.5 minutes to about 15 minutes, and is preferably about 10 minutes, and the predetermined PRV offset amount can range from 0% to about 5% of the range of pre-rotation vane motion, and is preferably about 3%. In the stall waiting state 304, the diffuser ring 210 of the variable geometry diffuser 119 is held or maintained in the same position that the diffuser ring 210 of the variable geometry diffuser 119 had in the previous state to thereby hold or maintain the opening in the diffuser space 204.

The stall reacting state 306 is entered in response to the detection of stall in the compressor 108 in either the stall waiting state 304 or the probing state 308. A more detailed description of the process and components for one technique for detecting stall in the compressor 108 is provided in U.S. patent application Ser. No. 10/641,277, filed on Aug. 14, 2003, which patent application is hereby incorporated by reference. However, it is to be understood that any suitable stall detection technique can be used with the present invention. The stability control algorithm 300 remains in the stall reacting state 306 until the stall condition that is detected in the compressor 108 is corrected or remedied or until a surge condition is detected in the compressor 108. In one embodiment of the present invention, the stall condition is considered corrected or remedied in response to a corresponding stall sensor voltage being less than a predetermined stall minimum threshold voltage, which predetermined stall minimum threshold voltage can range from about 0.4 V to about 0.8 V, and is preferably about 0.6 V. In the stall reacting state 306, the diffuser ring 210 of the variable geometry diffuser 119 is continuously extended toward a closed position to thereby close the opening in the diffuser space 204 until the stall condition that has been detected in the compressor 108 is corrected or remedied. Upon correcting or remedying the stall condition in the stall reacting state 306, the stability control algorithm 300 returns to the stall waiting state 304.

The probing state 308 is entered in response to the expiration of the predetermined stall waiting period or the movement of the pre-rotation vanes 120 by more than the predetermined PRV offset amount in the stall waiting state 304. In addition, the probing state 308 can be entered following the expiration of a predetermined surge waiting period in the surge waiting state 310. The stability control algorithm 300 remains in the probing state 308 until a stall condition or a surge condition is detected in the compressor 108. In one embodiment of the present invention, the stall condition is detected in response to a corresponding stall sensor voltage being greater than a predetermined stall maximum threshold voltage, which predetermined stall maximum threshold voltage can range from about 0.6 V to about 1.2 V, and is preferably about 0.8 V. In the probing state 308, the diffuser ring 210 of the variable geometry diffuser 119 is opened or retracted to thereby increase the opening in the diffuser space 204 until a surge condition or stall condition is detected in the compressor 108. In one embodiment of the present invention, the diffuser ring 210 of the variable geometry diffuser 119 is opened or retracted in incremental amounts or steps triggered by pulses having a predetermined pulse interval that can range from about 0.5 seconds to about 5 seconds and is preferably about 1 or 2 seconds. At lower compressor loads, e.g., less than 70% of compressor capacity, a stall condition is typically detected and controlled before a surge condition can occur. However, at higher compressor loads, e.g., more than 70% of compressor capacity and very high heads or lifts, a surge condition can occur while in the probing state 308, which may be momentary in nature and not detected as stall noise.

The surge reacting state 312 is entered in response to the detection of surge in the compressor 108 in either the stall waiting state 304, the stall reacting state 306 or the probing state 308. A more detailed description of the process and components for one technique for detecting surge in the compressor 108 is provided in U.S. Pat. No. 6,427,464, which patent is hereby incorporated by reference. However, it is to be understood that any suitable surge detection technique can be used with the present invention. The stability control algorithm 300 remains in the surge reacting state 312 until a predetermined surge reaction time has expired. In one embodiment of the present invention, the predetermined surge reaction time can range from about 1 second to about 30 seconds, and is preferably about 5 seconds. In the surge reacting state 312, the diffuser ring 210 of the variable geometry diffuser 119 is continuously extended toward a closed position over the predetermined surge reaction time period to thereby reduce the diffuser space or gap 204 to provide a more stable compressor operating capacity. The surge reaction time period can vary depending on overall speed of the variable geometry diffuser ring mechanism 212 and drive actuator motor, and the desired VGD ring 210 movement needed to achieve surge stability.

The surge waiting state 310 is entered upon the correcting or remedying of a surge condition in the compressor 108 in the surge reacting state 312. The stability control algorithm 300 remains in the surge waiting state 310 until a predetermined surge waiting period expires or the compressor 108 enters into another surge condition. In one embodiment of the present invention, the predetermined surge waiting period can range from about 0.5 minutes to about 15 minutes, and is preferably about 10 minutes. In the surge waiting state 310, the diffuser ring 210 of the variable geometry diffuser 119 is held or maintained in the same position that the diffuser ring 210 of the variable geometry diffuser 119 had in the previous state to thereby hold or maintain the opening in the diffuser space 204. In one embodiment, the stability control algorithm 300 may re-enter the surge reacting state 312 in response to the detection of another surge condition in the surge waiting state 310. Alternatively, another control algorithm may be used in response to the detection of another surge condition in the surge waiting state 310. These additional surge events may be counted independently or as part of the control algorithm to determine when to shutdown the compressor 108. In the event of continued surges in a short time period, the stability control algorithm 300 or another control algorithm may provide alarms or shutdown protection of the compressor 108 to avoid damaging the compressor 108. Otherwise, the stability control algorithm 300 enters the probing state 308 in response to the expiration of the predetermined surge waiting period in the surge waiting state 310.

Figure 4:
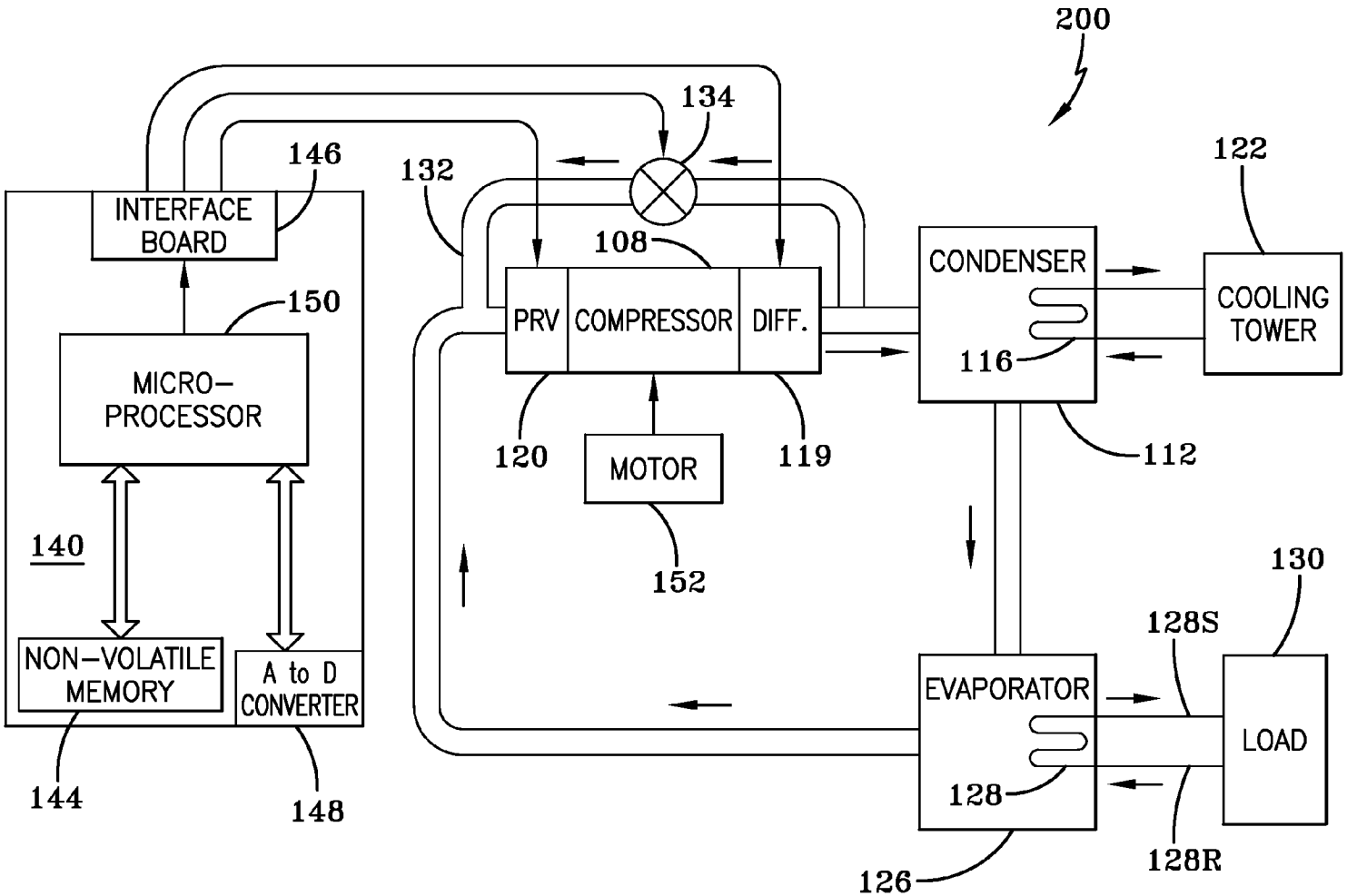
FIG. 4 illustrates schematically an alternate embodiment of the refrigeration system of the present invention.

FIG. 4 illustrates an alternate embodiment of a refrigeration system that can be used with the present invention. The refrigeration system 200 illustrated in FIG. 4 is substantially similar to the refrigeration system 100 illustrated in FIG. 1 and described in detail above except that a hot gas bypass line 132 and a hot gas bypass (HGBP) valve 134 are connected between the outlet or discharge of compressor 108 and the inlet of the pre-rotation vanes 120 to permit compressed refrigerant from the compressor discharge to be diverted or recycled back to the inlet of the compressor 108, when the HGBP valve 134 is open, in response to the presence of a surge condition. The position of the HGBP valve 134 is controlled to regulate the amount of compressed refrigerant, if any, that is provided to the compressor 108. A description of one control process for the HGBP valve 134 is provided in U.S. Pat. No. 6,427,464, which patent is hereby incorporated by reference. However, it is to be understood that any suitable HGBP valve 134 and corresponding control process can be used with the present invention.

FIG. 5 is a state diagram representation of an alternate embodiment of the stability control algorithm for maintaining system and compressor stability. As illustrated in FIG. 5, the state diagram 500 for an embodiment of the stability control algorithm for providing stability control to the system 200 of FIG. 4 is similar to the state diagram for stability control algorithm 300 illustrated in FIG. 3 and described in detail above except for the addition of a seventh primary control state, a hot gas override state 314 and the corresponding intra-connections to the hot gas override state 314, which are described below.

The hot gas override state 314 is entered in response to the compressor 108 experiencing a second surge condition while in the surge waiting state 310 instead of possibly returning to the surge reacting state 312 or using another control algorithm in response to the detection of another surge condition as described above with respect to the stability control algorithm 300. In addition, the stability control algorithm 500 can enter the hot gas override state 314 from the stall waiting state 304, the stall reacting state 306 or the probing state 308 in response to the detection of a HGBP valve open command from another control algorithm controlling the system. The HGBP valve open command can be generated as described in U.S. Pat. No. 6,427,464, which patent is hereby incorporated by reference, or using any other suitable HGBP valve control process. Furthermore, the operation of the HGBP valve 134 in the hot gas override state 314 is controlled as described above. The stability control algorithm 500 remains in the hot gas override state 314 until the HGBP valve 134 returns to a closed position. In the hot gas override state 314, the diffuser ring 210 of the variable geometry diffuser 119 is held or fixed in position whenever the HGBP valve 134 is in an open position to thereby hold or fix the opening in the diffuser space 204 in order to keep the variable geometry diffuser 119 at a position of similar surge stability when the system head is later lowered and the HGBP valve 134 is closed. Upon the closing of the HGBP valve 134 in the hot gas override state 314, the stability control algorithm 500 enters the stall waiting state 304.

In another embodiment of the present invention, the motor 152 is connected to a variable speed drive (not shown) that varies the speed of the motor 152. The varying of the speed of the compressor by the variable speed drive (VSD)

affects both the refrigerant vapor flow rate through the system and will also affect the compressor's stability relative to surge conditions. The stability control algorithms 300, 500 discussed above may be used in conjunction with a variable speed drive. When a variable speed drive is present, adaptive capacity control logic utilizing system operating parameters and compressor PRV position information can be used to operate the compressor at a faster speed when a surge is detected while the stability control algorithms 300, 500 are in the surge reacting state 312. In addition, past performance parameters are mapped and stored in memory to avoid future surge conditions by the adaptive capacity control logic. A description of one adaptive capacity control process is provided in U.S. Pat. No. 4,608,833 which patent is hereby incorporated by reference. However, it is to be understood that any suitable adaptive capacity control process can be used with the present invention.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A chiller system comprising:

a compressor, a condenser, and an evaporator connected in a closed refrigerant circuit;

the compressor comprising:

a compressor inlet to receive uncompressed refrigerant vapor from the chiller system;

a compressor outlet to discharge compressed refrigerant vapor to the chiller system; and a diffuser being disposed adjacent to the compressor outlet, the diffuser comprising a diffuser space configured to permit passage of compressed refrigerant vapor to the compressor outlet and a diffuser ring adjustably positioned in the diffuser space to vary a size of the diffuser space to control flow of compressed refrigerant vapor through the diffuser space; and a stability control system to control the position of the diffuser ring in the diffuser space in response to the detection of stall conditions or surge conditions in the compressor to maintain stable operation of the compressor.

2. The chiller system of claim 1 wherein the stability control system extends the diffuser ring into the diffuser space in response to the detection of a surge condition.

3. The chiller system of claim 2 wherein the stability control system continuously extends the diffuser ring into the diffuser space for a predetermined surge reaction time period in response to the detection of a surge condition.

4. The chiller system of claim 3 wherein the predetermined surge reaction time period is between about 1 and about 30 seconds.

5. The chiller system of claim 1 wherein the stability control system extends the diffuser ring into the diffuser space in response to the detection of a stall condition.

6. The chiller system of claim 5 wherein the stability control system continuously extends the diffuser ring into the diffuser space in response to the detection of a stall condition until the detected stall condition is corrected or a surge condition is detected.

7. The chiller system of claim 1 wherein the stability control system holds the diffuser ring in position in the diffuser space in response to a predetermined condition.

8. The chiller system of claim 1 wherein the stability control system retracts the diffuser ring from the diffuser space in response to a predetermined condition.

9. The chiller system of claim 8 wherein the stability control system incrementally retracts the diffuser ring from the diffuser space in response to pulses having a predetermined pulse interval until a stall condition is detected or a surge condition is detected.

10. The chiller system of claim 9 wherein the predetermined pulse interval is between about 0.5 seconds and about 5 seconds.

11. The chiller system of claim 1 further comprising a hot gas bypass valve connected between the compressor outlet and the compressor inlet, the hot gas bypass valve being configured to permit a portion of the compressed refrigerant vapor to flow from the compressor outlet to the compressor inlet.

12. The chiller system of claim 11 wherein the stability control system holds the diffuser ring in position in the diffuser space in response to the hot gas bypass valve being opened.

13. A stability control system for maintaining stable operation of a centrifugal compressor having a compressor inlet, a compressor outlet and a variable geometry diffuser with an adjustable flow passage, the stability control system comprising:

a stall reacting state to adjust a flow passage of a variable geometry diffuser in response to detecting a stall condition in a centrifugal compressor; and a surge reacting state to adjust a flow passage of a variable geometry diffuser in response to detecting a surge condition in a centrifugal compressor.

14. The stability control system of claim 13 wherein the surge reacting state is configured to continuously close a flow passage of a variable geometry diffuser for a predetermined surge reaction time period.

15. The stability control system of claim 14 wherein the predetermined surge reaction time period is between about 1 second and about 30 seconds.

16. The stability control system of claim 13 wherein the stall reacting state is configured to continuously close a flow passage of a variable geometry diffuser until the detected stall condition is corrected or a surge condition is detected.

17. The stability control system of claim 13 further comprising a probing state to adjust a flow passage of a variable geometry diffuser to obtain an optimal position for a diffuser ring.

18. The stability control system of claim 17 wherein the probing state is configured to incrementally open a flow passage of a variable geometry diffuser until a stall condition is detected or a surge condition is detected.

19. The stability control system of claim 13 further comprising a surge waiting state to hold a position of a flow passage of a variable geometry diffuser in response to a surge condition being corrected in the surge reacting state.

20. The stability control system of claim 19 wherein the surge waiting state is configured to hold a position of a flow passage of a variable geometry diffuser until a predetermined surge waiting period expires or a second surge condition occurs.

21. The stability control system of claim 20 wherein the predetermined surge waiting time period is between about 30 seconds and about 15 minutes.

22. The stability control system of claim 20 further comprising a hot gas override state to hold a position of a flow passage of a variable geometry diffuser in response to the occurrence of a second surge condition in the surge waiting state.

23. The stability control system of claim 13 further comprising a stall waiting state to hold a position of a flow passage of a variable geometry diffuser in response to one of correction of a stall condition in the stall reacting state and starting of a compressor.

24. The stability control system of claim 23 wherein the stall waiting state is configured to hold a position of a flow passage of a variable geometry diffuser until one of a predetermined stall waiting period expires, pre-rotation vanes are moved more than a predetermined threshold amount, a stall condition occurs and a surge condition occurs.

25. The stability control system of claim 24 wherein the predetermined stall waiting period is between about 5 minutes and about 15 minutes.

26. The stability control system of claim 24 wherein the predetermined threshold amount is greater than 0% and less than or equal to about 5% of a range of pre-rotation vane motion.

27. The stability control system of claim 13 wherein the surge reacting state has priority over the stall reacting state.

28. The stability control system of claim 13 further comprising a startup state to fully open a flow passage of a variable geometry diffuser prior to staffing a compressor.

29. A method of providing stability control in a centrifugal compressor having a variable geometry diffuser with an adjustable flow passage, the method comprising the steps of:

repeatedly detecting for a surge condition in a centrifugal compressor during operation of a centrifugal compressor;

repeatedly detecting for a stall condition in a centrifugal compressor during operation of a centrifugal compressor;

continuously closing a flow passage of a variable geometry diffuser in response to the detection of a surge condition in a centrifugal compressor for a predetermined surge reaction time period; and continuously closing a flow passage of a variable geometry diffuser in response to the detection of a stall condition in a centrifugal compressor until the detected stall condition is corrected or a surge condition is detected.

30. The method of claim 29 wherein the predetermined surge reaction time period is between about 1 second and about 30 seconds.

31. The method of claim 29 further comprising the step of incrementally opening a flow passage of a variable geometry diffuser in response to a predetermined condition until one of a stall condition is detected and a surge condition is detected.

32. The method of claim 29 further comprising the step of holding a position of a flow passage of a variable geometry diffuser in response to a surge condition being corrected in the surge reacting state until a predetermined surge waiting period expires or a second surge condition occurs.

33. The method of claim 32 wherein the predetermined surge waiting time period is between about 30 seconds and about 15 minutes.

34. The method of claim 29 further comprising the step of fully opening a flow passage of a variable geometry diffuser in response to stopping a centrifugal compressor.

35. The method of claim 29 further comprising the step of holding a position of a flow passage of a variable geometry diffuser in response to one of correction of a stall condition and starting of a centrifugal compressor until one of a predetermined stall waiting period expires, pre-rotation vanes are moved more than a predetermined threshold amount, a stall condition occurs and a surge condition occurs.

36. The method of claim 35 wherein the predetermined stall waiting period is between about 5 minutes and about 15 minutes.

37. The method of claim 35 wherein the predetermined threshold amount is greater than 0% and less than or equal to about 5% of a range of pre-rotation vane motion.

* * * * *